US006224642B1

(12) United States Patent
Daly et al.

(10) Patent No.: US 6,224,642 B1
(45) Date of Patent: May 1, 2001

(54) ADDITIVE COMPOSITION

(75) Inventors: Daniel T. Daly, Solon; Paul E. Adams, Willoughby Hills; Mitchell M. Jackson, Chagrin Falls, all of OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 09/448,560

(22) Filed: Nov. 23, 1999

(51) Int. Cl.[7] ..... C10L 1/18; C10L 1/22

(52) U.S. Cl. ..... 44/434; 44/331; 44/385; 44/388; 44/389; 44/418

(58) Field of Search ..... 44/434, 443, 331, 44/385, 388, 389, 418

(56) References Cited

U.S. PATENT DOCUMENTS

| | | | | |
|---|---|---|---|---|
| 3,440,029 | * | 4/1969 | Little | 44/434 |
| 4,032,303 | * | 6/1977 | Dorer et al. | 44/398 |
| 4,298,708 | | 11/1981 | Schulze et al. | 521/115 |
| 4,321,060 | | 3/1982 | Sung et al. | 44/53 |
| 4,332,595 | | 6/1982 | Herbstman et al. | 44/72 |
| 4,409,000 | * | 10/1983 | LeSuer | 44/434 |
| 4,526,587 | | 7/1985 | Campbell | 44/73 |
| 4,564,372 | | 1/1986 | Campbell | 44/71 |
| 4,568,358 | | 2/1986 | Courtney | 44/57 |
| 4,604,103 | | 8/1986 | Campbell | 44/72 |
| 4,609,377 | | 9/1986 | Sung et al. | 44/56 |
| 4,778,481 | | 10/1988 | Courtney | 441/57 |
| 4,832,702 | | 5/1989 | Kummer et al. | 441/62 |
| 4,964,879 | | 10/1990 | Herbstman et al. | 44/434 |
| 5,089,029 | | 2/1992 | Hashimoto et al. | 44/432 |
| 5,094,667 | | 3/1992 | Schilowitz et al. | 449/434 |
| 5,192,335 | | 3/1993 | Cherpeck | 44/487 |
| 5,264,006 | | 11/1993 | Schilowitz et al. | 44/434 |
| 5,660,601 | | 8/1997 | Oppenlander et al. | 44/433 |

* cited by examiner

*Primary Examiner*—Margaret Medley
*Assistant Examiner*—Cephia D. Toomer
(74) *Attorney, Agent, or Firm*—Michael F. Esposito, Esq.

(57) ABSTRACT

This invention relates to a composition, comprising:

(A) a compound represented by the formula $$RO(C_4H_8O)_nCH_2CH_2CH_2NH_2 \quad (I)$$

wherein in formula (I), R is an aliphatic hydrocarbyl group of about 8 to about 30 carbon atoms, an n is a number in the range of about 12 to about 30; and (B) a compound selected from the group consisting of: a fatty acid; a fatty acid amide; a fatty acid ester; an amide, imide or ester derived from a hydrocarbyl substituted succinic acid or anhydride wherein the hydrocarbyl substituent has about 8 to about 30 carbon atoms; an alkoxylated amine, and mixtures of two or more thereof. The invention also relates to concentrates and fuels containing the foregoing composition.

23 Claims, No Drawings

ADDITIVE COMPOSITION

TECHNICAL FIELD

This invention relates to compositions which are useful as fuel additives and, more particularly, to fuel additives which are useful in reducing engine wear.

BACKGROUND OF THE INVENTION

The reduction of engine wear in internal combustion engines is a continuing problem. Many engine wear problems are addressed through the use of appropriate lubricating oil applications. However, engine wear reduction also often necessitates the formulation of fuels such as diesel fuel and gasoline with enhanced lubricity characteristics. The present invention provides a solution to the problem of reducing engine wear by providing a fuel additive combination that enhances the lubricity characteristics of fuels such as diesel fuel, gasoline, and the like.

U.S. Pat. No. 5,089,029 discloses a fuel oil composition which comprises fuel oil and 0.1 to 50,000 ppm of an additive compound having the formula $$R—O—(AO)_m—(C_3H_6NH)_nH$$

in which R is a hydrocarbyl radical having 10 to 50 carbon atoms, A is an alkylene group having 2 to 6 carbon atoms, m is an integer of 10 to 50, and n is an integer of 1 to 3.

U.S. Pat. No. 5,660,601 discloses fuels for gasoline engines which contain small amounts of polyetheramines represented by the formula $$R^1—(OBu)_n—NR^2R^3 \quad (I)$$

where: $R^1$ is $C_2$—$C_{30}$-alkyl; $R^2$ and $R^3$, independently of one another, are each hydrogen, $C_1$–$C_6$-alkyl, aminoalkylene of the general formula $$—R^4—NR^5R^6 \quad (II)$$

or polyaminoalkylene of the general formula $$—R^4—NR^5)_m—R^6 \quad (III)$$

where: $R^4$ is $C_2$–$C_{10}$-alkylene; $R^5$ and $R^6$, independently of one another, are each hydrogen or $C_1$–$C_6$-alkyl; m is from 2 to 8; and Bu is a butylene radical derived from butylene oxide and n is from 12 to 28.

SUMMARY OF THE INVENTION

This invention relates to a composition, comprising:

(A) a compound represented by the formula $$RO(C_4H_8O)_nCH_2CH_2CH_2NH_2 \quad (I)$$

wherein in formula (I), R is an aliphatic hydrocarbyl group of about 8 to about 30 carbon atoms, an n is a number in the range of about 12 to about 30; and (B) a compound selected from the group consisting of: a fatty acid; a fatty acid amide; a fatty acid ester; an amide, imide or ester derived from a hydrocarbyl substituted succinic acid or anhydride wherein the hydrocarbyl substituent has about 8 to about 30 carbon atoms; an alkoxylated amine; and mixtures of two or more thereof.

The invention also relates to concentrates and fuels containing the foregoing composition.

The inventive compositions are useful in enhancing the lubricity characteristics of fuels such as diesel fuel, gasoline, and the like. The inventive compositions, in one embodiment, are also useful in reducing intake valve deposits. The inventive compositions, in one embodiment, are useful in improving fuel economy.

DESCRIPTION OF THE PREFERRED EMBODIMENTS

As used herein, the terms "hydrocarbyl substituent," "hydrocarbyl group," "hydrocarbyl substituted," "hydrocarbon group," and the like, are used to refer to a group having one or more carbon atoms directly attached to the remainder of a molecule and having a hydrocarbon or predominantly hydrocarbon character. Examples include:

(1) purely hydrocarbon groups, that is, aliphatic (e.g., alkyl, alkenyl or alkylene), and alicyclic (e.g., cycloalkyl, cycloalkenyli groups, aromatic groups, and aromatic-, aliphatic-, and alicyclic-substituted aromatic groups, as well as cyclic groups wherein the ring is completed through another portion of the molecule (e.g., two substituents together forming an alicyclic group);

(2) substituted hydrocarbon groups, that is, hydrocarbon groups containing non-hydrocarbon groups which, in the context of this invention, do not alter the predominantly hydrocarbon nature of the group (e.g., halo, hydroxy, alkoxy, mercapto, alkylmercapto, nitro, nitroso, and sulfoxy);

(3) hetero substituted hydrocarbon groups, that is, hydrocarbon groups containing substituents which, while having a predominantly hydrocarbon character, in the context of this invention, contain other than carbon in a ring or chain otherwise composed of carbon atoms. Heteratoms include sulfur, oxygen, nitrogen. In general, no more than two, and in one embodiment no more than one, non-hydrocarbon substituent is present for every ten carbon atoms in the hydrocarbon group.

The term "lower" when used in conjunction with terms such as alkyl, alkenyl, and alkoxy, is intended to describe such groups that contain a total of up to 7 carbon atoms.

Component (A) is a compound represented by the formula $$RO(C_4H_8O)_nCH_2CH2CH_2NH_2 \quad (I)$$

wherein in formula (I), R is an aliphatic hydrocarbyl group of about 8 to about 30 carbon atoms, and n is a number in the range of about 12 to about 30. R can be an straight chain or branched chain alkyl or alkenyl group. In one embodiment, R is a branched chain alkyl groups consisting of a straight chain back bone with one or more methyl groups, and in one embodiment 2 to about 6 methyl groups, and in one embodiment about 4 methyl groups, attached as side chains to the back bone. In one embodiment, R has 8 to 15 carbon atoms, and in one embodiment 12 to 14 carbon atoms, and in one embodiment 13 carbon atoms. In one embodiment, n is a number in the range of about 18 to about 22. In one embodiment, R has 13 carbon atoms, and n is about 20. In one embodiment, component (A) is a compound represented by the formula (I-A)

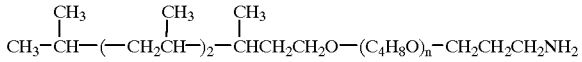

wherein in formula (I-A), n is a number in the range of about 12 to about 30, and in one embodiment n is about 18 to about 22, and in one embodiment n is about 20.

The compound represented by the formula (I) may be prepared by cyanoethylating an adduct of an alcohol, having about 8 to about 30 carbon atoms and an alkylene oxide with acrylonitrile and hydrogenating the obtained product, if necessary, followed by the repetition of the cyanoethylation and the hydrogenation. The cyanoethylation is conducted by stirring the reaction system under heating in the presence of a strong base catalyst such as caustic alkali. The hydrogenation may be conducted in the presence of a hydrogenation catalyst such as Raney nickel.

When the compound represented by the formula (I) is prepared by the above process, the alcohol ROH [wherein R is the same as that defined for the formula (I)] to be used as a raw material has about 8 to about 30 carbon atoms. Examples of the alcohol include branched-chain monohydric alcohols prepared by the Oxo process. These include tridecyl, isodecyl, 2-ethylhexyl alcohols, and the like. Examples of the alcohol also include straight-chain even carbon numbered alcohols prepared by the Ziegler process such as octyl, decyl, dodecyl, tetradecyl, and the like. Also contemplated are various saturated and unsaturated natural alcohols.

Component (B) is a fatty acid; a fatty acid amide; a fatty acid ester; an amide, imide or ester derived from a hydrocarbyl substituted succinic acid or anhydride and an amine or an alcohol; an alkoxylated amine; or a mixture of two or more thereof.

The term "fatty acid" as used in the specification and claims refers to acids which may be obtained by the hydrolysis of a naturally occurring vegetable or animal fat or oil. These acids usually contain from about 8 to about 22 carbon atoms and include, for example, caprylic acid, capric acid, palmitic acid, stearic acid, oleic acid, linoleic acid, etc. Acids containing from about 10 to about 22 carbon atoms are useful, and in one embodiment, those acids containing from about 16 to about 18 carbon atoms can be used.

The hydrocarbyl-substituted succinic acid or anhydride used in making the amides, imides and esters derived from such acid or anhydride may be represented by the formulae

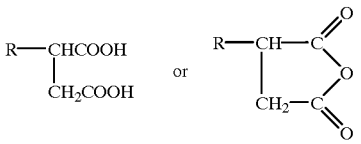

wherein R is a hydrocarbyl group of about 8 to about 30 carbon atoms, and in one embodiment about 8 to about 18 carbon atoms, and in one embodiment about 12 carbon atoms. In one embodiment R is an alkyl or an alkenyl group. The hydrocarbyl group R may be derived from ethylene, propylene, 1-butene, isobutylene, 1-pentene, 2-methyl-1-butene, 3-methyl-1-butene, 1-hexene, 1-heptene, 1-octene, styrene, 1-nonene, 1-decene, 1-undecene, 1-dodecene, 1-tridecene, 1-tetradecene, 1-pentadecene, 1-hexadecene, 1-heptadecene and 1-octadecene. Higher olefin mixtures such as olefins in the range of about 18 to about 24 carbon atoms may be used. The hydrocarbyl group R may be derived from an alpha-olefin fraction such as the fractions containing $C_{15-18}$ alpha-olefins, $C_{12-16}$ alpha-olefins, $C_{14-16}$ alpha-olefins, $C_{14-18}$ alpha-olefins, and $C_{16-18}$ alpha-olefins, and the like. The hydrocarbyl group R may be derived from branched olefins such as diisobutylene, propylene tetramer, branched nonenes, and the like.

The amines useful in making the fatty acid amides, and the amides and imides derived from hydrocarbyl substituted succinic acid or anhydride include those represented by the formula

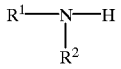

wherein $R^1$ and $R^2$ are independently hydrogen, hydrocarbyl groups, amino-substituted hydrocarbyl groups, hydroxy-substituted hydrocarbyl groups, or alkoxy-substituted hydrocarbyl groups. Thus, the amine may be ammonia, an aliphatic amine, aliphatic hydroxy or thioamine, aromatic amine, heterocyclic amine, or carboxylic amine. The amine may be a primary or secondary amine. The primary amines are useful in making amides or imides, while the secondary amines are useful in making amides. The amine may be a polyamine such as alkylene polyamine, arylene polyamine, cyclic polyamine, or a hydroxy-substituted derivative of such polyamine. Examples include methylamine, dimethylamine, N-methyl-ethylamine, N-methyloctylamine, N-cyclohexyl-amine, dibutylamine, cyclohexylamine, aniline, dodecylamine, octadecylamine, o-phenylenediamine, N,N'-di-n-butyl-p-phenylenediamine, morpholine, piperazine, tetrahydropyrazine, indole, hexahydro-1,3,5-triazine, 1-H-1,2,4-triazole, melamine, bis-(p-aminophenyl)methane, phenyl-methylenimine, menthanediamine, cyclohexiamine, pyrrolidine, 3-amino-5,6-diphenyl-1,2,4-triazine, ethanolamine, diethanolamine, quinonedi-imine, 1,3-indandiimine, 2-octadecylimidazoline, 2-phenyl-4-methyl-imidazolidine, oxazolidine, 2-heptyl-oxazolidine, and mixtures of two or more thereof.

The amine may be a hydroxyl-containing amine represented by the formula

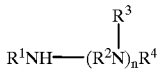

wherein each of $R^1$, $R^3$ and $R^4$ is independently hydrogen or a hydrocarbyl, hydroxyhydrocarbyl, aminohydrocarbyl, or hydroxyaminohydrocarbyl group provided that at least one of $R^3$ is a hydroxyhydrocarbyl or a hydroxyaminohydrocarbyl group. $R^2$ may be an alkylene group, such as ethylene or propylene, and in one embodiment ethylene. n is a number ranging from zero to about 5. Examples include ethanolamine, 2-amino-1-butanol, 2-amino-2-methyl-1-propanol, di-(3-hydroxybutylamine, 3-hydroxybutyl-amine, 4-hydroxybutylamine, 2-amino-1-butanol, 2-amino-2-methyl-1-propanol, 2-amino-1-propanol, 3-amino-2-methyl-1-propanol, 3-amino-1-propanol, 2-amino-2-methyl- 1,3-propanediol, 2-amino-2-ethyl- 1,3-propanediol, diethanolamine, di-(2-hydroxypropyl)-amine, N-(hydroxypropyl)-propylamine, N-(2-hydroxyethyl)-cyclohexylamine, 3-hydroxycyclopentylamine, N-hydroxyethyl piperazine, or a mixture of two or more thereof.

The amine may be a polyamine represented by the formula

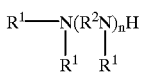

wherein n is a number in the range of zero to about 10, and in one embodiment about 1 to about 7. Each $R^1$ independently is hydrogen or a hydrocarbyl group of up to about 30 carbon atoms. $R^2$ is an alkylene group that contains up to about 10 carbon atoms, with methylene, ethylene and propylene being useful. These alkylene amines include methylene amines, ethylene amines, butylene amines, propylene amines, pentylene amines, hexylene amines, heptylene amines, octylene amines, other polymethylene amines, and also the cyclic and the higher homologues of such amines such as piperazines and amino-alkyl-substituted piperazines. Examples includes: ethylene diamine, triethylene tetramine, propylene diamine, decamethylene diamine, octamethylene diamine, di(heptamethylene)triamine, tripropylene tetramine, tetraethylene pentamine, trimethylene diamine, pentaethylene hexamine, di(trimethylene)-triamine, 2-heptyl-3-(2-aminopropyl)imidazoline, 4-methylimidazoline, 1,3-bis(2-aminoethyl)imidazoline, pyrimidine, 1-( 2-aminopropyl)piperazine. 1,4-bis(2-aminoethyl) piperazine, and 2-methyl-1-(2-aminobutyl)piperazine, or a mixture of two or more thereof. Higher homologues such as are obtained by condensing two or more of the above-illustrated alkylene amines likewise are useful.

Hydroxyalkyl-substituted alkylene amines, i.e., alkylene amines having one or more hydroxyalkyl substituents on the nitrogen atoms, may be used as the amine reactant. The hydroxyalkyl-substituted alkylene amines include those in which the alkyl group is a lower alkyl group. Examples of such amines include N-(2-hydroxyethyl)ethylene diamine, N,N'-bis(2-hydroxyethyl) ethylene diamine, 1-(2-hydroxyethyl)piperazine, monohydroxypropyl-substituted diethylene triamine, 1,4-bis-(2-hydroxypropyl)piperazine, di-hydroxypropyl-substituted tetraethylene pentamine, N-(3-hydroxypropyl)tetramethylene diamine, 2-heptadecyl-1(2-hydroxyethyl)-imidazoline, and mixtures of two or more thereof.

Higher homologues such as are obtained by condensation of the above-illustrated alkylene amines or hydroxyalkyl-substituted alkylene amines through amino groups or through hydroxy groups are likewise useful as the amine reactant. It will be appreciated that condensation through amino groups results in a higher amine accompanied with removal of ammonia and that condensation through the hydroxy groups results in products containing ether linkages accompanied with removal of water.

The amides and imides may be prepared using techniques well known to those skilled in the art, such as reaction of the hydrocarbyl succinic acid or anhydride with an amine or polyamine described above followed by removal of water.

The alcohols useful in making the fatty acid esters and the esters derived from hydrocarbyl substituted succinic acid or anhydride include mono- or polyhydric hydrocarbon-based alcohols such as methanol, ethanol, the propanols, butanols, pentanols, hexanols, heptanols, octanols and decanols; also included are fatty alcohols and mixtures thereof, including saturated alcohols such as lauryl, myristyl, cetyl, stearyl and behenyl alcohols, and unsaturated alcohols such as palmitoleyl, oleyl and eicosenyl. Higher synthetic monohydric alcohols of the type formed by the Oxo process (e.g., 2-ethylhexanol), by the aldol condensation, or by organoaluminum-catalyzed oligomerization of alphaolefins (especially ethylene), followed by oxidation, are also useful. These higher alcohols are discussed in detail under the title "Alcohols, Higher Aliphatic" in Kirk-Othmer, *Encyclopedia of Chemical Technology*, Third Edition, Vol. 1, pp. 716–754. Also useful are the alicyclic analogs of the above-described alcohols; examples are cyclopentanol, cyclohexanol and cyclododecanol. These alcohols typically contain from 1 to about 40 carbon atoms, and in one embodiment about 2 to about 12 carbon atoms, and in one embodiment about 2 to about 5 carbon atoms, and in one embodiment 2 or 3 carbon atoms.

The polyhydric alcohols include those which contain from 2 to about 8 or 10 hydroxyl groups, and in one embodiment from about 2 to about 4 hydroxyl groups. Examples of suitable polyhydric alcohols include ethylene glycol, propylene glycol, neopentylene glycol, glycerol, pentaerythritol, etc. Ethylene glycol and glycerol are useful. Polyhydric alcohols containing lower alkoxy groups such as methoxy and/or ethoxy groups may be utilized.

In one embodiment, the fatty acid ester is a partial fatty acid ester of a polyhydric alcohol. Suitable partial fatty acid esters of polyhydric alcohols include, for example, glycol monoesters, glycerol mono- and diesters, and pentaerythritol di- and/or triesters. The partial fatty acid esters of glycerol are useful, and of the glycerol esters, monoesters, or mixtures of monoesters and diester may be utilized. In one embodiment, the partial fatty acid ester contains olefinic unsaturation, and this olefinic unsaturation usually is found in the acid moiety of the ester. In addition to the fatty acids discussed above, acids such as octeneoic acid, tetradeceneoic acid, etc., can be utilized in forming the esters.

The esters and partial fatty acid esters may be prepared by methods well known in the art, such as by direct esterification of an acid with an alcohol, reaction of an acid with an epoxide, etc.

Useful esters include the ester-acid derived from the reaction of one mole of dodecyl succinic acid and one mole of 1,3-propane diol, and glycerol monooleate.

The alkoxylated amines include those having the formula

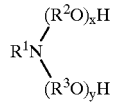

wherein $R^1$ is an alkyl or alkenyl group having about 14 to about 30 carbon atoms, each of $R^2$ and $R^3$is a vicinal alkylene group and each of x and y is an integer and is at least 1, the total of x and y being about 6 or less. $R^1$ may be a tetradecyl, pentadecyl, hexadecyl, octadecyl, eicosyl, tetradecenyl or octadecenyl group or the like. Mixtures of amines containing different $R^1$ groups may be used. Each of $R^2$ and $R^3$ is a vicinal alkylene group. The term "vicinal" means that the free valence bonds of the group (attached to oxygen and/or nitrogen) are on adjacent carbon atoms. $R^2$and $R^3$ may be identical. The total of x and y may be about 4 or less, and in one embodiment about 2. $R^1$ may be a fatty alkyl or alkenyl group. By "fatty alkyl or alkenyl" is meant an alkyl or alkenyl group which is derived from a natural fat or oil, or from a derivative thereof such as the corresponding nitrile, by hydrogenation of the ester or nitrile group. Examples of fatty alkyl and alkenyl groups include myristyl (tetradecyl), palmityl (hexadecyl), stearyl (octadecyl) and oleyl (9-octadecenyl) groups.

Useful alkoxylated amines include the "Ethomeens", a series of commercial mixtures of alkoxylated fatty amines available from Akzo Company. Suitable "Ethomeens" include "Ethomeen O/12", "Ethomeen S/12", "Ethomeen T/12" and "Ethomeen 18/12". In these compounds $R^2$ and $R^3$are ethylene groups, each of x and y is 1, and $R^1$ is respectively oleyl, a mixture of alkyl and alkenyl groups derived from soybean oil, a mixture of alkyl and alkenyl groups derived from tallow, and stearyl.

The normally liquid hydrocarbon fuel may be a hydrocarbonaceous petroleum distillate fuel such as motor gasoline as defined by ASTM Specification D439 or diesel fuel or fuel oil as defined by ASTM Specification D396. Normally liquid hydrocarbon fuels comprising non-hydrocarbonaceous materials such as alcohols, ethers, organo-nitro compounds and the like (e.g., methanol, ethanol, diethyl ether, methyl ethyl ether, nitromethane) are also within the scope of this invention as are liquid fuels derived from vegetable or mineral sources such as corn, alfalfa, shale and coal. Normally liquid hydrocarbon fuels which are mixtures of one or more hydrocarbonaceous fuels and one or more non-hydrocarbonaceous materials are also contemplated. Examples of such mixtures are combinations of gasoline and ethanol and of diesel fuel and ether.

In one embodiment, the normally liquid hydrocarbon fuel is gasoline, that is, a mixture of hydrocarbons having an ASTM distillation range from about 60° C. at the 10% distillation point to about 205° C. at the 90% distillation point. In one embodiment, the gasoline is a chlorine-free or low-chlorine gasoline characterized by a chlorine content of no more than about 10 ppm.

The diesel fuels that are useful with this invention can be any diesel fuel. These diesel fuels typically have a 90% point distillation temperature in the range of about 300° C. to about 390° C., and in one embodiment about 330° C. to about 350° C. The viscosity for these fuels typically ranges from about 1.3 to about 24 centistokes at 40° C. The diesel fuels can be classified as any of Grade Nos. 1-D, 2-D or 4-D as specified in ASTM D975. These diesel fuels may contain alcohols and esters. In one embodiment the diesel fuel has a sulfur content of up to about 0.05% by weight as determined by the test method specified in ASTM D2622-87. In one embodiment, the diesel fuel is a chlorine-free or low-chlorine diesel fuel characterized by a chlorine content of no more than about 10 ppm.

Generally, the inventive fuel compositions contain an effective amount of component (A) and component (B) to enhance the lubricity characteristics of the fuel composition. In one embodiment, components (A) and (B) are useful in reducing intake valve deposits and are added to fuel compositions in effective amounts to reduce intake valve deposits. Component (A) may be added to the fuel at a concentration of about 10 to about 5000 parts by weight, and in one embodiment 20 to about 5000 parts by weight, and in one embodiment about 50 to about 1000 parts by weight per million parts of fuel. Component (B) may be added to the fuel at a concentration of about 0.5 to about 500 parts by weight, and in one embodiment about 0.5 to about 100 parts by weight, and in one embodiment about 1 to about 50 parts by weight per million parts of fuel.

The fuel compositions may contain, in addition to component (A) and component (B), other additives which are well known to those of skill in the art. These include antiknock agents such as tetraalkyl lead compounds, lead scavengers such as haloalkanes (e.g., ethylene dichloride and ethylene dibromide), deposit preventers or modifiers such as triaryl phosphates, dyes, cetane improvers, antioxidants such as 2,6-di-tertiary-butyl-4-methyl-phenol, corrosion inhibitors such as alkylated succinic acids and anhydrides, bacteriostatic agents, gum inhibitors, metal deactivators, demulsifiers, upper cylinder lubricants, anti-icing agents, ashless dispersants, and mixtures of two or more thereof.

Component (A) and component (B) may be added directly to the fuel, or they may be diluted with a normally liquid organic diluent such as naphtha, benzene, toluene, xylene to form an additive concentrate. These concentrates generally contain from about 10% to about 90% by weight a mixture of component (A) and component (B), and may contain, one or more other conventional additives known in the art or described hereinabove.

EXAMPLE 1

Part A

Tridecyl alcohol (4.00 lbs; 1814.4 g.: 9.07 moles) is charged to a five-gallon nitrogen filled autoclave. Agitation is commenced. An aqueous solution of potassium hydroxide (0.30 lb; 134.7 g.; 45% KOH) is added. The reactor is purged with purified nitrogen and heated to 126.7° C. while applying vacuum to strip water. At 126.7° C., vacuum stripping is conducted for 0.5 hr. The vacuum is relieved with nitrogen @ 100 mm Hg pressure. Butylene oxide (29.0 lbs; 13.16 kg.; 182.75 moles) is added over a 6-10 hour time period at a rate such that the reactor temperature does not drop below 121° C. or exceed 132° C., and the reactor's pressure does not exceed 80 psi. After the butylene oxide addition is complete, the temperature is maintained at 126.7° C. for 2 hours. The reactor's pressure is allowed to equilibrate and decrease less than 10 psi. The reactor pressure is vented slowly to zero psi. The product mixture is cooled to 82° C. while it is vacuum stripped. The vacuum is relieved with nitrogen. Solid magnesium silicate (1.2 lbs.) is added to neutralize the reaction product. The product mixture is stirred for one hour. The product is cooled to 49–60° C. The reaction product is filtered until its residual potassium level is 10 ppm or less. The product has a hydroxyl number (ASTM E326-96) of 34.5, a viscosity at 100° C. (ASTM D445) of 21.3 cSt, and a specific gravity (ASTM D4052) of 0.9614 g/cc.

Part B

The product from Part (A) (3.8 mol) is introduced to a 5 liter 4-neck round bottom flask equipped with a thermometer, overhead stirrer, condenser, and a dropping funnel. A few drops of 45 wt % KOH in water are added to catalyze the reaction. The contents of the flask are heated to 30° C. with stirring. Acrylonitrile (271.3 g, 5.1 mol) is charged to the dropping funnel and approximately 50 ml aliquots are added over a couple of minutes at about 15 to 20 minute intervals initially over 5 hours in such a manner that maintained the temperature at less than 40° C. After adding 247 g of the acrylonitrile, an additional 4 g of 45 wt % KOH in water are added. The last 24.3 g of acrylonitrile are then added, while monitoring the nitrile and hydroxyl functionality by infrared spectroscopy. The mixture is stirred an additional 1 hour until the infrared spectrum shows no further conversion of hydroxyl functionality. Approximately 70% of the hydroxyl groups are reacted according to the infrared analysis. Water (10 ml) is added. The mixture is allowed to sit an hour at 40° C. and the water settles. 0.5 N hydrochloric acid is then added dropwise with stirring until the pH of the reaction mixture is neutral. The neutralized solution is filtered to remove any acrylonitrile polymer and inorganic salts. The product (3200 g) is an amber colored filtrate of ether nitrile.

Part C

Raney Nickel catalyst (40 g, 1.3 wt %, based on ether nitrile) is washed 3 times with 500 ml aliquots of isopropanol. In the first two cases, the solvent is decanted off and fresh solvent added. After suspending the catalyst in the third aliquot of isopropanol, the mixture is added to a two gallon autoclave reactor. The ether nitrile prepared in Part B above (3200 g, 3.5 mol) is then added to the reactor and stirred. A vacuum of 25 in. Hg is applied to the system and the contents of the reactor are heated to 120° C. The isopropanol and any residual water is removed by distillation over two hours until no condensate is seen forming on the condensor. The reactor is sealed. Hydrogen is then added to a pressure of 10 psi and the reactor is vented. The hydrogen purge and venting are repeated. Hydrogen is again added to a pressure of 10 psig and the contents of the reactor cooled over a few minutes to 70° C. The temperature of the reactor contents is increased to 135° C. (pressure increases to 160 psig) over approximately 30 minutes. Hydrogen is added to maintain the total pressure at 320 psi and the temperature is maintained at 135° to 140° C. for 32 hours. The reactor contents are cooled to 120° C., vented, and a vacuum of 25 in. Hg applied. The reactor contents are vacuum distilled for two hours, further cooled to 50° C., then drained from the reactor and filtered. The product (2950 grams) is tridecoxy (butoxy)n-n-propylene amine wherein n is a number in the range of 12 to 30, with about 85 to 90% of n being in the range of 18 to 22. The produce has a nitrogen content of 0.71% by weight and a total base number of 28.5.

EXAMPLE 2

The following concentrate is prepared:

| | Weight % |
|---|---|
| (1) Product of Example 1. | 57.5% |
| (2) Aromatic petroleum naphtha solvent having a specific gravity of 0.874, a flash point of 104° F. and a viscosity @ 25° C. of 0.9 sSt. | 41.5% |
| (3) Dodecenyl succinic acid-ester derived from one mole of dodecenyl succinic acid and one mole of 1,3-propanediol. | 0.5% |
| (4) Ethoxylated demulsifier. | 0.5% |

Gasoline formulations are prepared by adding the foregoing concentrate to gasoline at the treatment levels of 260 ppm, 320 ppm and 412 ppm.

EXAMPLE 3

The enhanced lubricity characteristics of fuel compositions containing the inventive additive combination are demonstrated by the following test results wherein the fuels are tested with a high frequency reciprocating rig using test method ASTM D6079-97. With these results improvement is indicated when the diameter of the wear scar is reduced. The results are indicated in the following Table 1.

TABLE I

| | A | B | C | D | E | F |
|---|---|---|---|---|---|---|
| Fuel: diesel fuel (D) or gasoline (G) | D | D | D | D | G | G |
| Product of Example 1, ppm | — | 396.5 | 149.5 | 238 | — | 400 |
| Ester derived from dodecyl succinic acid and 1,3-propane diol, ppm | — | 3.5 | 1.5 | — | — | — |
| Glycerol monooleate, ppm | — | — | — | 42 | — | 20 |
| Wear scar diameter, mm | 0.514 | 0.34 | 0.29 | 0.28 | 0.71 | 0.34 |
| Reduction of wear scar vs. base % | — | 33.9% | 43.6% | 45.5% | — | 52.1% |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A composition, comprising:

(A) a compound represented by the formula $$RO(C_4H_8O)_nCH_2CH_2CH_2NH_2 \quad (I)$$

wherein in formula (I), R is an aliphatic hydrocarbyl group of about 8 to about 30 carbon atoms, and n is a number in the range of about 12 to about 30; and (B) a compound selected from the group consisting of: a fatty acid; a fatty acid amide; a fatty acid ester; an amide, imide or ester derived from a hydrocarbyl substituted succinic acid or anhydride wherein the hydrocarbyl substituent has about 8 to about 30 carbon atoms; an alkoxylated amine; and mixtures of two or more thereof.

2. The composition of claim 1 wherein in formula (I), R has 8 to 15 carbon atoms.

3. The composition of claim 1 wherein in formula (I), R has 12 to 14 carbon atoms.

4. The composition of claim 1 wherein in formula (I), n is a number in the range of about 18 to about 22.

5. The composition of claim 1 wherein in formula (I), R has 13 carbon atoms, and n is about 20.

6. The composition of claim 1 wherein component (A) is represented by the formula (I-A)

$$CH_3-\underset{|}{CH}-(-CH_2\underset{|}{CH}-)_2-\underset{|}{CH}CH_2CH_2O-(C_4H_8O)_n-CH_2CH_2CH_2NH_2$$

wherein in formula (I-A), n is a number in the range of about 12 to about 30.

7. The composition of claim 1 wherein (B) is a fatty acid or is an amide or imide derived from a fatty acid, said fatty acid containing about 8 to about 22 carbon atoms.

8. The composition of claim 1 wherein (B) is a fatty acid or is an amide or an imide derived from a fatty acid, said fatty acid being selected from the group consisting of caprylic acid, capric acid, palmitic acid, stearic acid, oleic acid, linoleic acid, or a mixture of two or more thereof.

9. The composition of claim 1 wherein (B) is derived from a hydrocarbyl substituted succinic acid or anhydride represented by the formula

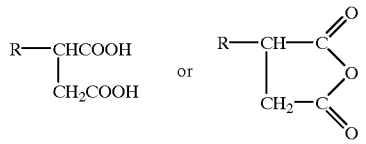

wherein R is a hydrocarbyl group of about 8 to about 30 carbon atoms.

10. The composition of claim 1 wherein (B) is an alkoxylated amine represented by the formula

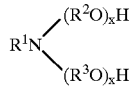

wherein $R^1$ is an alkyl or alkenyl group having about 14 to about 30 carbon atoms, each $R^2$ and $R^3$ is a vicinal alkylene group, and each x and y is an integer that is at least 1, the total of x and y being about 6 or less.

11. The composition of claim 10 wherein $R^2$ and $R^3$ are ethylene groups; each of x and y is 1; and $R^1$ is oleyl, a mixture of alkyl and alkenyl groups derived from soybean oil, a mixture of alkyl and alkenyl groups derived from tallow, or stearyl.

12. A composition made by mixing:

(A) a compound represented by the formula $$RO(C_4H_8O)_nCH_2CH_2CH_2NH_2 \quad (I)$$

wherein in formula (I), R is an aliphatic hydrocarbyl group of about 8 to about 30 carbon atoms, and n is a number in the range of about 12 to about 30; and (B) a compound selected from the group consisting of: a fatty acid; a fatty acid amide; a fatty acid ester; an amide, imide or ester derived from a hydrocarbyl substituted succinic acid or anhydride wherein the hydrocarbyl substituent has about 8 to about 30 carbon atoms; an alkoxylated amine; and mixtures of two or more thereof.

13. A composition, comprising:

(A) a compound represented by the formula $$RO(C_4H_8O)_nCH_2CH_2CH_2NH_2 \quad (I)$$

wherein in formula (I), R is an aliphatic hydrocarbyl group of about 8 to about 30 carbon atoms, and n is a number in the range of about 12 to about 30; and (B) a compound selected from the group consisting of: a fatty acid; a fatty acid amide; a fatty acid ester; an amide or imide derived from a hydrocarbyl substituted succinic acid or anhydride wherein the hydrocarbyl substituent has about 8 to about 30 carbon atoms; an alkoxylated amine; and mixtures of two or more thereof.

14. A composition, comprising:

(A) a compound represented by the formula (I-A)

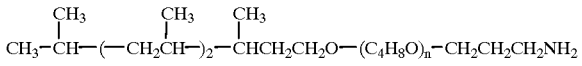

wherein in formula (I-A), n is a number in the range of about 12 to about 30; and (B) a compound selected from the group consisting of oleic acid, glycerol monooleate, and an ester-acid derived from dodecyl succinic acid and 1,3-propane diol.

15. A concentrate, comprising: a normally liquid organic diluent; and from about 10% to about 90% by weight of the composition of claim 1.

16. A fuel composition, comprising: a normally liquid hydrocarbon fuel; and the composition of claim 1.

17. The fuel composition of claim 16 wherein said normally liquid hydrocarbon fuel is gasoline or diesel fuel.

18. The fuel composition of claim 16 wherein said fuel composition further comprises an antiknock agent, lead scavenger, dye, cetane improver, antioxidant, corrosion inhibitor, bacteriostatic agent, gum inhibitor, metal deactivator, demulsifier, upper cylinder lubricant, anti-icing agent, ashless dispersant, or mixture of two or more thereof.

19. A process for fueling an internal combustion engine comprising fueling said engine with the fuel composition of claim 16.

20. A composition, comprising:

(A) a compound represented by the formula $$RO(C_4H_8O)_nCH_2CH_2CH_2NH_2 \quad (I)$$

wherein in formula (I), R is an aliphatic hydrocarbyl group of about 8 to about 30 carbon atoms, and n is a number in the range of about 12 to about 30; and (B) oleic acid.

21. A composition, comprising:

(A) a compound represented by the formula $$RO(C_4H_8O)_nCH_2CH_2CH_2NH_2 \quad (II)$$

wherein in formula (I), R is an aliphatic hydrocarbyl group of about 8 to about 30 carbon atoms, and n is a number in the range of about 12 to about 30; and (B) glycerol monooleate.

22. A composition, comprising:

(A) a compound represented by the formula $$RO(C_4H8O)_nCH_2CH_2CH_2NH_2 \quad (I)$$

wherein in formula (I), R is an aliphatic hydrocarbyl group of about 8 to about 30 carbon atoms, and n is a number in the range of about 12 to about 30; and (B) an ester-acid derived from dodecyl succinic acid and 1,3-propane diol.

23. A composition, comprising:

(A) a compound represented by the formula $$RO(C_4H_8O)_nCH_2CH_2CH_2NH_2 \quad (I)$$

wherein in formula (I), R is an aliphatic hydrocarbyl group of about 8 to about 30 carbon atoms, and n is a number in the range of about 12 to about 30; and (B) a compound selected from the group consisting of: a fatty acid; a fatty acid amide; a fatty acid ester; an amide, imide or ester derived from a hydrocarbyl substituted succinic acid or anhydride wherein the hydrocarbyl substituent has about 8 to about 30 carbon atoms; and mixtures of two or more thereof.

* * * * *